US006811838B2

(12) United States Patent
Romano, Jr. et al.

(10) Patent No.: US 6,811,838 B2
(45) Date of Patent: Nov. 2, 2004

(54) INK RECORDING ELEMENT

(75) Inventors: Charles E. Romano, Jr., Rochester, NY (US); David M. Teegarden, Pittsford, NY (US)

(73) Assignee: Eastman Kodak Company, Rochester, NY (US)

( * ) Notice: Subject to any disclaimer, the term of this patent is extended or adjusted under 35 U.S.C. 154(b) by 85 days.

(21) Appl. No.: 10/068,675

(22) Filed: Feb. 6, 2002

(65) Prior Publication Data

US 2003/0213394 A1 Nov. 20, 2003

(51) Int. Cl.[7] ..... B41M 5/40
(52) U.S. Cl. ..... 428/32.23; 428/32.27; 428/32.3; 428/32.38; 347/105
(58) Field of Search ..... 428/32.23, 32.27, 428/32.3, 32.38; 347/105

(56) References Cited

U.S. PATENT DOCUMENTS

| | | | | | |
|---|---|---|---|---|---|
| 4,946,741 | A | * | 8/1990 | Aono et al. | 428/32.14 |
| 5,075,153 | A | | 12/1991 | Malhotra | 427/207 |
| 5,478,631 | A | * | 12/1995 | Kawano et al. | 428/32.1 |
| 5,567,507 | A | | 10/1996 | Paff et al. | 428/213 |
| 5,984,467 | A | | 11/1999 | Bodager et al. | 347/101 |
| 6,015,624 | A | | 1/2000 | Williams | 428/500 |
| 6,068,373 | A | | 5/2000 | Chen et al. | 347/105 |
| 6,086,985 | A | | 7/2000 | Shaw-Klein et al. | 428/304.4 |
| 6,089,704 | A | | 7/2000 | Burns et al. | 347/105 |
| 6,197,409 | B1 | | 3/2001 | Bodager et al. | 428/212 |
| 6,214,458 | B1 | * | 4/2001 | Kobayashi et al. | 428/332 |
| 6,420,016 | B1 | * | 7/2002 | Peternell et al. | 428/195 |
| 6,461,422 | B1 | * | 10/2002 | Yang et al. | 106/287.35 |
| 2001/0003461 | A1 | * | 6/2001 | Romano, Jr. et al. | 347/101 |
| 2001/0020972 | A1 | * | 9/2001 | Kovacs et al. | 347/96 |
| 2002/0164459 | A1 | * | 11/2002 | Steiger | 428/195 |

FOREIGN PATENT DOCUMENTS

| | | |
|---|---|---|
| DE | 19721238 | 11/1998 |
| EP | 0 782 931 A1 | 7/1997 |
| EP | 0 791 475 A2 | 8/1997 |
| EP | 0 995 610 A2 | 4/2000 |
| EP | 1 101 625 A2 | 5/2001 |
| EP | 1 110 745 A2 | 6/2001 |
| EP | 1 110 745 A3 | 8/2001 |
| EP | 1 284 199 A2 | 2/2003 |
| WO | 98/30392 | 7/1998 |

OTHER PUBLICATIONS

KODAK Premium Picture Paper (Eastman Kodak Company).

Co–pending U.S. Ser. No. 10/068,446, Charles E. Romano, Jr. et al., *Ink Recording Element Having Adhesion Promoting Material* (D–82840).

Co–pending U.S. Ser. No. 10/068,824, Charles E. Romano, Jr., *Ink Recording Element* (D–83245).

Co–pending U.S. Ser. No. 10/068,827, Charles E. Romano, Jr. et al., *Ink Recording Element Containing A Laminate Adhesion Promoting Inner Layer* (D–83885).

* cited by examiner

*Primary Examiner*—B. Shewareged
(74) *Attorney, Agent, or Firm*—Lynne M. Blank

(57) ABSTRACT

The present invention relates to an ink recording element comprising a hydrophilic absorbing layer and a hydrophilic overcoat polymer layer comprising cellulose ether and a vinyl latex polymer.

An optional inner layer may be placed between the hydrophilic absorbing layer and the laminate adhesion promoting hydrophilic overcoat polymer. Another embodiment of the invention relates to an ink printing method comprising providing an ink recording element as described above, and applying liquid ink droplets thereon in an image-wise manner.

26 Claims, No Drawings

INK RECORDING ELEMENT

CROSS REFERENCE TO RELATED APPLICATIONS

Reference is made to commonly assigned, co-pending U.S. Patent Applications:

Ser. No. 10/068,446 by Charles E. Romano, Jr. et al. filed of even date herewith entitled "Ink Recording Element Having Adhesion Promoting Humectant Absorbing Material";

Ser. No. 10/068,827 by Charles E. Romano, Jr. et al. filed of even date herewith entitled "Ink Recording Element Containing Laminate Adhesion Promoting Layer"; and Ser. No. 10/068,824 by Charles E. Romano, Jr. filed of even date herewith entitled "Ink Recording Element", the disclosures of which are incorporated herein.

FIELD OF THE INVENTION

The present invention relates to an ink image-recording element.

BACKGROUND OF THE INVENTION

In a typical inkjet recording or printing system, ink droplets are ejected from a nozzle at high speeds towards a recording element or medium to produce an image on the medium. The recording elements typically comprise a support or a support material having on at least one surface thereof an ink-receiving or image-forming layer. In order to achieve and maintain high quality images on such an image-recording element, the recording element must:

Exhibit no banding, bleed, coalescence, or cracking in inked areas.

Exhibit the ability to absorb large amounts of ink and dry quickly to avoid blocking.

Exhibit high optical densities in the printed areas.

Exhibit freedom from differential gloss.

Have high levels of image fastness to avoid fade from contact with water or radiation by daylight, tungsten light, or fluorescent light.

Have excellent adhesive strength so that delamination does not occur.

While a wide variety of different types of image-recording elements for use with inkjet devices have been proposed heretofore, there are many unsolved problems in the art and many deficiencies in the known products which have severely limited their commercial usefulness. A major challenge in the design of an image-recording element is laminate adhesion. A typical coating from the prior art comprises a layer containing hydroxypropylmethyl cellulose, hydroxyethyl cellulose and a vinyl latex polymer, a layer of pectin, a layer of poly(vinyl alcohol) and polyurethane, and a layer of lime processed osseine gelatin in the order recited. This formulation has demonstrated poor laminate adhesion. U.S. Pat. No. 6,089,704 discloses an inkjet recording element comprising a support, a hydrophilic image-recording layer and an overcoat layer comprising a vinyl latex polymer further comprising a hydrophobic monomer, a hydrophilic nonionic monomer and a cationic monomer. However, the image quality of this element is often poor. U.S. Pat. No. 6,015,624 discloses an inkjet recording element which has a base layer comprised of a blend of poly(ethylene-co-acrylic acid) and at least one hydrophilic liquid absorbent polymer and an ink transmissive upper layer of methyl cellulose, hydroxypropylmethyl cellulose and blends thereof and an organic acid salt. U.S. Pat. No. 5,567,507 discloses an inkjet recording element which has a base layer comprised of a blend of poly(ethylene-co-acrylic acid) and polyvinylpyrrolidinone and an upper layer which comprises methyl cellulose, hydroxypropylmethyl cellulose and blends thereof and an organic acid salt. EP 1 110 745 discloses an inkjet recording element which has a hydrophilic absorbing layer comprising gelatin or poly(vinyl alcohol), a laminate adhesion promoting layer comprising pectin or alginate and a hydrophilic overcoat layer comprising hydroxyethyl cellulose and blends thereof and an organic acid salt. These inkjet recording elements, as disclosed, demonstrate inadequate laminate adhesion. DE 197 21 238 A1 discloses the use of a single layer of succinylated pigskin gelatin in inkjet papers It is an object of this invention to provide an ink recording element which has excellent image quality, less differential gloss, and better laminate adhesion than the elements of the prior art.

SUMMARY OF THE INVENTION

In accordance with the invention, there is provided an ink recording element comprising a support having a hydrophilic absorbing layer and a hydrophilic overcoat polymer layer comprising cellulose ether and a vinyl latex polymer.

The ink recording element of the invention produces advantages with respect to improved image quality, less differential gloss, and improved laminate adhesion when compared to the elements of the prior art.

DETAILED DESCRIPTION OF THE INVENTION

These and other objects are achieved in accordance with the invention which comprises an ink recording element comprising a hydrophilic absorbing layer and a hydrophilic overcoat polymer layer comprising cellulose ether and a vinyl latex polymer. The preferred use for this element is as an inkjet recording element.

The present invention provides for improvements in laminate adhesion over the prior art. Laminate adhesion is the adhesion of the recording element to the laminate. Compositional changes in any of the various layers may affect laminate adhesion. Lamination as used herein is the process of applying a thin plastic film having an adhesive layer on one side on top of the ink receiving layers, usually with the aid of heat and/or pressure. The film can be glossy, semi-glossy or matte and may contain additives modifying its optical properties. The film usually has a thickness of between 25–250 microns (1–10 mils).

A preferred embodiment of the invention comprises a support having thereon, in the order recited, a hydrophilic absorbing layer comprising modified gelatin, a laminate adhesion promoting hydrophilic overcoat polymer comprising a mixture of hydroxypropylmethyl cellulose, methyl cellulose and a vinyl latex polymer where the polymer has the following formula:

$$—A_x—B_y—C_z—$$

wherein:

A is a hydrophilic or reactive, vinyl monomer such as hydroxyethyl acrylate, hydroxyethyl methacrylate, acrylic acid, methacrylic acid, itaconic acid, vinyl alcohol, acrylamide, methacrylamide, hydroxyethylacrylamide, 2-(methacryloyloxy)ethyl acetoacetate, or N-isobutoxymethacrylamide, B is a hydrophobic, vinyl monomer such as methyl acrylate, methyl methacrylate, butyl acrylate, butyl methacrylate, ethyl acrylate, ethyl methacrylate, isopropyl acrylate, cyclohexyl acrylate, norbornyl acrylate, vinyl acetate, vinyl neodeconate or styrene, C is a vinyl monomer bearing ionic charge such as [2-(acryloyloxy)ethyl]trimethylammonium chloride, [2-(acryloyloxy)ethyl]trimethylammonium methylsulfate, [2-(methacryloyloxy)ethyl]trimethylammonium chloride, [2-(methacryloyloxy)ethyl]trimethylammonium methylsulfate, 2-aminoethyl methacrylate hydrochloride, 3-aminopropylmethacrylamide hydrochloride, 1-methyl-4-vinylpyridinium chloride, 1-methyl-3-vinylimidazolium iodide, 2-acrylamido-2-methyl-1-propanesulfonic acid sodium salt, or 3-methacryloyloxy-1-propanesulfonic acid, sodium salt, x is from about 10 to about 80 mole %, y is from about 0 to about 85 mole %, and z is from about 2 to about 20 mole %.

These materials are preferred due to their availability, effectiveness, and compatibility with the present invention.

An optional inner layer may be placed between the hydrophilic absorbing layer and the laminate adhesion promoting hydrophilic overcoat polymer. Another embodiment of the invention relates to an ink printing method comprising providing an ink recording element as described above, and applying liquid ink droplets thereon in an image-wise manner.

As noted above, the hydrophilic absorbing layer preferably comprises modified gelatin where the amino group is inactivated such as acetylated gelatin, phthaloylated gelatin, malenoylated gelatin, benzoylated gelatin, succinylated gelatin, gelatin modified with alkylene succinic acid, methyl urea gelatin, phenylcarbamoylated gelatin, and carboxy modified gelatin. This layer may also contain other hydrophilic materials such as unmodified gelatin and naturally-occurring hydrophilic colloids and gums such as albumin, guar, xantham, acacia, chitosan, starches and their derivatives, functionalized proteins, functionalized gums and starches, and cellulose ethers and their derivatives, polyvinyloxazoline, such as poly(2-ethyl-2-oxazoline) (PEOX), polyvinylmethyloxazoline, polyoxides, polyethers, poly(ethylene imine), poly(acrylic acid), poly(methacrylic acid), n-vinyl amides including polyacrylamide and polyvinylpyrrolidinone (PVP), and poly(vinyl alcohol) derivatives and copolymers, such as copolymers of poly(ethylene oxide) and poly(vinyl alcohol) (PEO-PVA). The layer may also contain inorganic oxides such as silica.

The hydrophilic absorbing layer must effectively absorb both the water and humectants commonly found inkjet printing inks. In a preferred embodiment of the invention, two hydrophilic absorbing layers are present, one comprising succinylated pigskin gelatin or alkylene modified succinylated pigskin gelatin, and the other comprising poly (vinyl alcohol) and a polyurethane dispersion. This embodiment produces improved image quality. The hydrophilic materials employed in the image-recording layer may be present in any amount which is effective for the intended purpose. In general, for a two layer structure as described above, the preferred dry thickness of the succinylated pigskin gelatin is from 5 microns to 60 microns, below which the layer is too thin to be effective and above which no additional gain in performance is noted with increased thickness. The preferred dry thickness of poly(vinyl alcohol) and polyurethane dispersion is from 0.5 microns to 5 microns as is common in practice.

As noted above, the hydrophilic overcoat comprises a mixture of hydroxypropylmethyl cellulose, methyl cellulose and a vinyl latex polymer. In a preferred embodiment of the invention, the hydrophilic overcoat layer comprises a mixture of hydroxypropylmethyl cellulose, methyl cellulose and poly(n-butyl acrylate-co-2-aminoethyl methacrylate-co-2-hydroxyethyl methacrylate). The preferred dry thickness of the overcoat layer is from 0.5 micron to 5 microns as is common in practice.

In a preferred embodiment of the invention, A is a hydrophilic, vinyl monomer that is nonionic at pH 2. In another preferred embodiment, A is an acrylic monomer. In still another preferred embodiment, B is an acrylate monomer. These monomers demonstrate availability and effectiveness in the present invention. In yet another preferred embodiment, x is from about 10 to about 50 mole %, y is from about 40 to about 70 mole % and z is from about 5 to about 15 mole %. The occurrence of poor adhesion results is increased outside these ranges.

Examples of the vinyl latex polymer useful in the invention include the following:

TABLE 1

| | Monomer | (mole %) |
|---|---|---|
| L-1 | Hydroxyethyl acrylate | (45) |
| | Methyl methacrylate | (45) |
| | [2-(Acryloyloxy)ethyl]trimethylammonium methylsulfate | (10) |
| L-2 | Methacrylic acid | (45) |
| | Methyl methacrylate | (45) |
| | [2-(Acryloyloxy)ethyl]trimethylammonium methylsulfate | (10) |
| L-3 | Hydroxyethyl acrylate | (45) |
| | Butyl acrylate | (45) |
| | [2-(Acryloyloxy)ethyl]trimethylammonium methylsulfate | (10) |
| L-4 | Methacrylic acid | (45) |
| | Butyl acrylate | (45) |
| | [2-(Acryloyloxy)ethyl]trimethylammonium methylsulfate | (10) |
| L-5 | Hydroxyethyl acrylate | (45) |
| | Methyl methacrylate | (45) |
| | [2-(Acryloyloxy)ethyl]trimethylammonium chloride | (10) |
| L-6 | Methacrylic acid | (45) |
| | Methyl methacrylate | (45) |
| | [2-(Acryloyloxy)ethyl]trimethylammonium chloride | (10) |
| L-7 | Hydroxyethyl acrylate | (45) |
| | Butyl acrylate | (45) |
| | [2-(Acryloyloxy)ethyl]trimethylammonium chloride | (10) |
| L-8 | Methacrylic acid | (45) |
| | Butyl acrylate | (45) |
| | [2-(Acryloyloxy)ethyl]trimethylammonium chloride | (10) |
| L-9 | Acrylic acid | (45) |
| | Methyl methacrylate | (45) |
| | [2-(Acryloyloxy)ethyl]trimethylammonium chloride | (10) |
| L-10 | Methacrylic acid | (45) |
| | Ethyl methacrylate | (45) |
| | [2-(Acryloyloxy)ethyl]trimethylammonium chloride | (10) |
| L-11 | Methacrylic acid | (45) |
| | Benzyl acrylate | (45) |
| | [2-(Acryloyloxy)ethyl]trimethylammonium chloride | (10) |
| L-12 | Acrylic acid | (45) |
| | Methyl acrylate | (45) |
| | [2-(Acryloyloxy)ethyl]trimethylammonium chloride | (10) |
| L-13 | Acrylic acid | (45) |
| | Ethyl methacrylate | (45) |
| | [2-(Acryloyloxy)ethyl]trimethylammonium chloride | (10) |

TABLE 1-continued

| | Monomer | (mole %) |
|---|---|---|
| L-14 | Methacrylic acid | (20) |
| | Methyl methacrylate | (70) |
| | [2-(Acryloyloxy)ethyl]trimethylammonium chloride | (10) |
| L-15 | Methacrylic acid | (30) |
| | Methyl methacrylate | (60) |
| | [2-(Acryloyloxy)ethyl]trimethylammonium chloride | (10) |
| L-16 | Methacrylic acid | (50) |
| | Methyl methacrylate | (40) |
| | [2-(Acryloyloxy)ethyl]trimethylammonium chloride | (10) |
| L-17 | Methacrylic acid | (70) |
| | Butyl acrylate | (20) |
| | [2-(Acryloyloxy)ethyl]trimethylammonium chloride | (10) |
| L-18 | Methacrylic acid | (20) |
| | Butyl acrylate | (80) |
| | [2-(Acryloyloxy)ethyl]trimethylammonium chloride | (10) |
| L-19 | Butyl acrylate | (60) |
| | Acrylic acid | (30) |
| | [2-(Acryloyloxy)ethyl]trimethylammonium chloride | (10) |
| L-20 | Butyl acrylate | (70) |
| | Methacrylic acid | (20) |
| | [2-(Acryloyloxy)ethyl]trimethylammonium chloride | (10) |
| L-21 | Butyl acrylate | (80) |
| | Methacrylic acid | (10) |
| | [2-(Acryloyloxy)ethyl]trimethylammonium chloride | (10) |
| L-23 | Butyl acrylate | (60) |
| | Methacrylic acid | (20) |
| | Methyl methacrylate | (10) |
| | [2-(Acryloyloxy)ethyl]trimethylammonium chloride | (10) |
| L-24 | Butyl acrylate | (60) |
| | Methacrylic acid | (15) |
| | Methyl methacrylate | (15) |
| | [2-(Acryloyloxy)ethyl]trimethylammonium chloride | (10) |
| L-25 | Butyl acrylate | (60) |
| | Methacrylic acid | (10) |
| | Methyl methacrylate | (20) |
| | [2-(Acryloyloxy)ethyl]trimethylammonium chloride | (10) |
| L-26 | Butyl acrylate | (60) |
| | N-isobutoxy methacrylamide | (30) |
| | [2-(Acryloyloxy)ethyl]trimethylammonium chloride | (10) |
| L-27 | Butyl acrylate | (75) |
| | Hydroxyethyl methacrylate | (10) |
| | 2-(Methacryloyloxy)ethyl acetoacetate | (10) |
| | 2-Acrylamido-2-methyl-1-propanesulfonic acid, sodium salt | (5) |
| L-28 | Butyl acrylate | (80) |
| | Hydroxyethyl methacrylate | (10) |
| | 2-(Methacryloyloxy)ethyl acetoacetate | (5) |
| | 2-Acrylamido-2-methyl-1-propanesulfonic acid, sodium salt | (5) |

TABLE 1-continued

| | Monomer | (mole %) |
|---|---|---|
| L-29 | Butyl acrylate | (86) |
| | Hydroxyethyl methacrylate | (5) |
| | 2-(Methacryloyloxy)ethyl acetoacetate | (6) |
| | 2-Acrylamido-2-methyl-1-propanesulfonic acid, sodium salt | (3) |
| L-30 | Butyl acrylate | (85) |
| | 2-(Methacryloyloxy)ethyl acetoacetate | (10) |
| | 2-Acrylamido-2-methyl-1-propanesulfonic acid, sodium salt | (5) |

The vinyl latex polymer used in the invention is the result of an emulsion polymerization. This includes both the solid polymer particles suspended in water and any water soluble polymers that may also be present in the water at the end of the reaction. Emulsion polymerization of vinyl monomers is described in Emulsion Polymerization and Emulsion Polymers by Lovell and El-Asser.

In general, latex particles useful in the invention contain three components which have shown good success. A hydrophobic monomer is used to provide a latex and to reduce tackiness. Tg may be controlled by the choice of this monomer. A hydrophilic or reactive, but not ionic monomer is used to increase laminate adhesion and provide good dry times. Finally a small quantity of an ionic monomer is typically used to contribute to particle stability.

Latex particles are stabilized by the use of surfactants in the polymerization, which remain in the finished latex. They may be used at any level that provides a good particle size and good particle stability, generally five weight percent or less. Useful surfactants may be anionic, cationic or nonionic and can be small molecule or polymeric. Cationic surfactants in receiver overcoats work well with the anionic dyes used in many inks. Examples of cationic surfactants include cetyltrimethylammonium bromide and Ethoquod® O/12. These cationic surfactants may also be used with additional nonionic surfactant with good results.

The vinyl latex polymers can be made by mixing the monomers in one feed stream that contains 2–4 monomers, but any number of compatible monomers can be used to achieve desired levels of hydrophilicity, and glass transition temperature.

As previously mentioned, the ink recording element may optionally contain at least one hydrophilic inner layer between the hydrophilic absorbing layer and the hydrophilic overcoat polymer layer. The inner layer may comprise a poly(vinyl alcohol) or a poly(vinyl alcohol) and a polyurethane dispersion. The inner layer typically has a dry thickness of from 0.5 to 5 microns.

In another preferred embodiment of the invention, the hydrophilic inner layer comprises poly(vinyl alcohol) and anionic, water-dispersible polyurethane polymers having the following general formula:

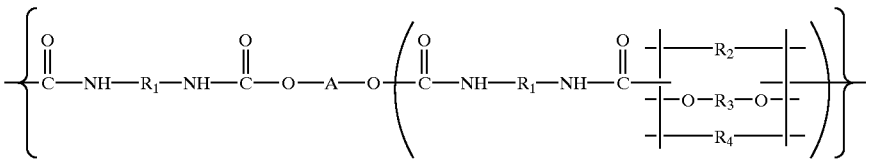

wherein:

$R_1$ is represented by one or more of the following structures:

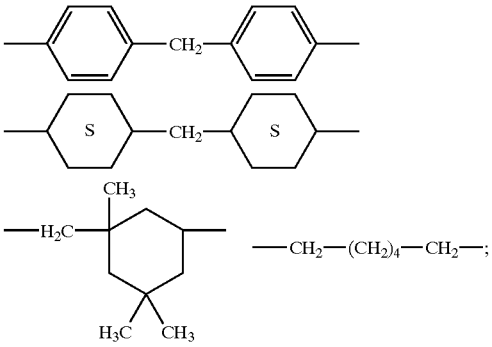

A represents the residue of a polyol, such as a) a dihydroxy polyester obtained by esterification of a dicarboxylic acid such as succinic acid, adipic acid, suberic acid, azelaic acid, sebacic acid, phthalic, isophthalic, terephthalic, tetrahydrophthalic acid, and the like, and a diol such as ethylene glycol, propylene-1,2-glycol, propylene-1,3-glycol, diethylene glycol, butane-1,4-diol, hexane-1,6-diol, octane-1,8-diol, neopentyl glycol, 2-methyl-propane-1,3-diol, nonane-1,9-diol or the various isomeric bis-hydroxymethylcyclohexanes; b) a polylactone such as polymers of ε-caprolactone and one of the above mentioned diols; c) a polycarbonate obtained, for example, by reacting one of the above-mentioned diols with diaryl carbonates or phosgene; or d) a polyether such as a polymer or copolymer of styrene oxide, propylene oxide, tetrahydrofuran, butylene oxide or epichlorohydrin;

$R_2$ represents the residue of a diol having a molecular weight less than about 500, such as the diols listed above for A; and $R_3$ represents an alkylene, arylene or aralkylene linking group containing one or more phosphonate, carboxylate or sulfonate groups which have been neutralized with a base, such as triethylamine, sodium hydroxide, potassium hydroxide, etc; and $R_4$ is optional and may represent the residue of a diamine having a molecular weight less than about 500, such as ethylene diamine, diethylene triamine, propylene diamine, butylene diamine, hexamethylene diamine, cyclohexylene diamine, phenylene diamine, tolylene diamine, xylylene diamine, 3,3'-dinitrobenzidene, 4,4'-methylenebis(2-chloroaniline), 3,3'-dichloro-4,4'-biphenyl diamine, 2,6-diaminopyridine, 4,4'-diamino diphenylmethane, and adducts of diethylene triamine with acrylate or its hydrolyzed products. These materials are preferred due to their availability and compatibility with the present invention.

The polyurethane employed in the invention preferably has a Tg between about −50° C. and 100° C. A plasticizer may also be added if desired. In a preferred embodiment of the invention, the polyurethane has a number average molecular weight of from about 5,000 to about 100,000, more preferably from 10,000 to 50,000. The anionic, water-dispersible polyurethane employed in the invention may be prepared as described in "Polyurethane Handbook", Hanser Publishers, Munich Vienna, 1985. An example of an anionic, water-dispersible polyurethane that may be used in the invention is Witcobond® 232 (Witco Corporation). Polyurethanes with these properties are readily available and effective in the present invention.

Matte particles may be added to any or all of the layers described in order to provide enhanced printer transport, resistance to ink offset, or to change the appearance of the ink receiving layer to satin or matte finish. In addition, surfactants, defoamers, or other coatability-enhancing materials may be added as required by the coating technique chosen.

Typically, dye mordants are added to ink receiving layers in order to improve water and humidity resistance. However, most mordant materials adversely affect dye light stability. Any polymeric mordant can be used in the image-recording layer of the invention provided it does not inordinately affect light fade resistance. For example, there may be used a cationic polymer, e.g., a polymeric quaternary ammonium compound, or a basic polymer, such as poly(N,N-dimethylaminoethyl methacrylate), polyalkylenepolyamines, and products of the condensation thereof with dicyanodiamide, amine-epichlorohydrin polycondensates, lecithin and phospholipid compounds. Examples of mordants useful in the invention include poly (vinylbenzyltrimethylammonium chloride-co-ethylene glycol dimethacrylate), poly(vinylbenzyltrimethylammonium chloride-co-divinylbenzene), poly (diallyldimethylammonium chloride), poly([2-(methacryloyloxy) ethyl]trimethylammonium methylsulfate), poly([3-(methacryloyloxy)propyl] trimethylammonium chloride), a copolymer of vinylpyrrolidinone and 1-vinyl-3-methylimidazolium chloride, and hydroxyethyl cellulose derivatized with 1-chloro-3-(N,N,N-trimethylammonium)propane.

Any support or substrate may be used in the recording element of the invention. The support for the ink recording element used in the invention can be any of those usually used for inkjet receivers, such as resin-coated paper, paper, polyesters, or microporous materials such as polyethylene polymer-containing material sold by PPG Industries, Inc., Pittsburgh, Pa. under the trade name of Teslin®, Tyvek® synthetic paper (DuPont Corp.), impregnated paper such as Duraform®, and OPPalyte® films (Mobil Chemical Co.) and other composite films listed in U.S. Pat. No. 5,244,861. Opaque supports include plain or calendered paper, coated paper, paper coated with protective polyolefin layers, synthetic paper, photographic paper support, melt-extrusion-coated paper, and laminated paper, such as biaxially oriented support laminates. Biaxially oriented support laminates are described in U.S. Pat. Nos. 5,853,965, 5,866,282, 5,874,205, 5,888,643, 5,888,681, 5,888,683, and 5,888,714, the disclosures of which are hereby incorporated by reference. These biaxially oriented supports include a paper base and a biaxially oriented polyolefin sheet, typically polypropylene, laminated to one or both sides of the paper base. Transparent supports include glass, cellulose derivatives, e.g., a cellulose ester, cellulose triacetate, cellulose diacetate, cellulose acetate propionate, cellulose acetate butyrate, polyesters, such as poly(ethylene terephthalate), poly(ethylene naphthalate), poly(1,4-cyclohexanedimethylene terephthalate), poly(butylene terephthalate), and copolymers thereof, polyimides, polyamides, polycarbonates, poly(vinyl chloride), polystyrene, polyolefins, such as polyethylene or polypropylene, polysulfones, polyacrylates, polyetherimides, and mixtures thereof. The papers listed above include a broad range of papers, from high end papers, such as photographic paper to low end papers, such as newsprint. In particular, polyethylene-coated paper or poly (ethylene terephthalate) are preferred and are commonly used in imaging applications.

The support is suitably of a thickness of from 50 to 500 μm, preferably from 75 to 300 μm to provide acceptable look and feel as well as effectiveness in the present invention. Antioxidants, antistatic agents, plasticizers, dyes, pigments and other known additives may be incorporated into the support, if desired.

In order to improve the adhesion of the image-receiving layer to the support, the surface of the support may be subjected to a corona-discharge treatment prior to applying the image-receiving layer. The adhesion of the image-receiving layer to the support may also be improved by coating a subbing layer on the support. Examples of materials useful in a subbing layer include halogenated phenols and partially hydrolyzed vinyl chloride-co-vinyl acetate polymer. In order to impart mechanical durability to an inkjet recording element, crosslinkers which act upon the binder discussed above may be added in small quantities. Such an additive improves the cohesive strength of the layer. Crosslinkers such as carbodiimides, polyfunctional aziridines, aldehydes, isocyanates, epoxides, polyvalent metal cations, and the like may all be used.

To improve colorant fade, UV absorbers, radical quenchers or antioxidants may also be added to the image-receiving layer as is well known in the art. Other additives include pH modifiers, adhesion promoters, rheology modifiers, surfactants, biocides, lubricants, dyes, optical brighteners, matte agents, and antistatic agents. In order to obtain adequate coatability, additives known to those familiar with such art such as surfactants, defoamers, alcohol and the like may be used. A common level for coating aids is 0.01 to 0.30 wt. % active coating aid based on the total solution weight. These coating aids can be nonionic, anionic, cationic or amphoteric. Specific examples are described in MCCUTCHEON's Volume 1: Emulsifiers and Detergents, 1995, North American Edition.

In another embodiment of the invention, a filled layer containing light scattering particles such as titania may be situated between a clear support material and the ink receptive multilayer described herein. Such a combination may be effectively used as a backlit material for signage applications. Yet another embodiment which yields an ink receiver with appropriate properties for backlit display applications results from selection of a partially voided or filled poly (ethylene terephthalate) film as a support material, in which the voids or fillers in the support material supply sufficient light scattering to diffuse light sources situated behind the image.

Optionally, an additional backing layer or coating may be applied to the backside of a support (i.e., the side of the support opposite the side on which the image-recording layers are coated) for the purposes of improving the machine-handling properties and curl of the recording element, controlling the friction and resistivity thereof, and the like.

Typically, the backing layer may comprise a binder and a filler. Typical fillers include inorganic oxides such as amorphous and crystalline silicas, poly(methyl methacrylate), hollow sphere polystyrene beads, micro-crystalline cellulose, zinc oxide, talc, and the like. The filler loaded in the backing layer is generally less than 5 percent by weight of the binder component and the average particle size of the filler material is in the range of 5 to 30 μm. Typical binders used in the backing layer are polymers such as polyacrylates, gelatin, polymethacrylates, polystyrenes, polyacrylamides, vinyl chloride-vinyl acetate copolymers, poly(vinyl alcohol), cellulose derivatives, and the like. Additionally, an antistatic agent also can be included in the backing layer to prevent static hindrance of the recording element. Particularly suitable antistatic agents are compounds such as dodecylbenzenesulfonic acid sodium salt, octylsulfonic acid potassium salt, oligostyrenesulfonic acid sodium salt, laurylsulfosuccinic acid sodium salt, and the like. The antistatic agent may be added to the binder composition in an amount of 0.1 to 15 percent by weight, based on the weight of the binder. An image-recording layer may also be coated on the backside, if desired.

While not necessary, the hydrophilic material layers described above may also include a crosslinker. Such an additive can improve the adhesion of the ink receptive layer to the substrate as well as contribute to the cohesive strength and water resistance of the layer. Crosslinkers such as carbodiimides, polyfunctional aziridines, melamine formaldehydes, isocyanates, epoxides, and the like may be used. If a crosslinker is added, care must be taken that excessive amounts are not used as this will decrease the swellability of the layer, reducing the drying rate of the printed areas.

Coating compositions employed in the invention may be applied by any number of well known techniques, including dip-coating, wound-wire rod coating, doctor blade coating, gravure and reverse-roll coating, slide coating, bead coating, extrusion coating, curtain coating and the like. Known coating and drying methods are described in further detail in Research Disclosure no. 308119, published December 1989, pages 1007 to 1008. Slide coating is preferred, in which the base layers and overcoat may be simultaneously applied. After coating, the layers are generally dried by simple evaporation, which may be accelerated by known techniques such as convection heating. Slide coating, in which the base layers and overcoat may be simultaneously applied is preferred as cost effective as well as useful in the present invention.

Inks used to image the recording elements of the present invention are well-known in the art. The ink compositions used in inkjet printing typically are liquid compositions comprising a solvent or carrier liquid, dyes or pigments, humectants, organic solvents, detergents, thickeners, preservatives, and the like. The solvent or carrier liquid can be solely water or can be water mixed with other water-miscible solvents such as polyhydric alcohols. Inks in which organic materials such as polyhydric alcohols are the predominant carrier or solvent liquid may also be used. Particularly useful are mixed solvents of water and polyhydric alcohols. The dyes used in such compositions are typically water-soluble direct or acid type dyes. Such liquid compositions have been described extensively in the prior art including, for example, U.S. Pat. No. 4,381,946, U.S. Pat. No. 4,239,543 and U.S. Pat. No. 4,781,758.

Although the recording elements disclosed herein have been referred to primarily as being useful for inkjet printers, they also can be used as recording media for pen plotter assemblies. Pen plotters operate by writing directly on the surface of a recording medium using a pen consisting of a bundle of capillary tubes in contact with an ink reservoir.

As used herein the phrase "recording element" is a material that may be used with an imaging support for the transfer of images to the element by techniques such as inkjet printing or thermal dye (ink) transfer The thermal dye (ink) image-receiving layer of the receiving elements of the invention may comprise, for example, a polycarbonate, a polyurethane, a polyester, polyvinyl chloride, poly(styrene-co-acrylonitrile), poly(caprolactone) or mixtures thereof. The ink-receiving layer may be present in any amount which is effective for the intended purpose.

Ink-donor elements that are used with the ink-receiving element of the invention conventionally comprise a support having thereon an ink containing layer. Any ink can be used in the ink-donor employed in the invention provided it is transferable to the ink-receiving layer by the action of heat. Especially good results have been obtained with sublimable inks. Ink donors applicable for use in the present invention are described, e.g., in U.S. Pat. Nos. 4,916,112; 4,927,803 and 5,023,228.

As noted above, ink-donor elements are used to form an ink transfer image. Such a process comprises image-wise-heating an ink-donor element and transferring an ink image to an ink-receiving element as described above to form the ink transfer image.

In a preferred embodiment of the thermal ink transfer method of printing, an ink donor element is employed which compromises a poly-(ethylene terephthalate) support coated with sequential repeating areas of cyan, magenta, and yellow dye, and the ink transfer steps are sequentially performed for each color to obtain a three-color ink transfer image. Of course, when the process is only performed for a single color, then a monochrome ink transfer image is obtained.

A thermal ink transfer assemblage of the invention comprises (a) an ink-donor element, and (b) an ink-receiving element as described above, the ink-receiving element being in a superposed relationship with the ink-donor element so that the ink layer of the donor element is in contact with the ink image-receiving layer of the receiving element.

When a three-color image is to be obtained, the above assemblage is formed on three occasions during the time when heat is applied by the thermal printing head. After the first ink is transferred, the elements are peeled apart. A second ink-donor element (or another area of the donor element with a different ink area) is then brought in register with the ink-receiving element and the process repeated. The third color is obtained in the same manner.

The electrographic and electrophotographic processes and their individual steps have been well described in detail in many books and publications. The processes incorporate the basic steps of creating an electrostatic image, developing that image with charged, colored particles (toner), optionally transferring the resulting developed image to a secondary substrate, and fixing the image to the substrate. There are numerous variations in these processes and basic steps; the use of liquid toners in place of dry toners is simply one of those variations.

The first basic step, creation of an electrostatic image, can be accomplished by a variety of methods. In one form of the electrophotographic process of copiers uses imagewise photodischarge, through analog or digital exposure, of an uniformly charged photoconductor. The photoconductor may be a single-use system, or it may be rechargeable and reimageable, like those based on selenium or organic photoreceptors.

In an alternate electrographic process, electrostatic images are created iono-graphically. The latent image is created on dielectric (charge-holding) medium, either paper or film. Voltage is applied to selected metal styli or writing nibs from an array of styli spaced across the width of the medium, causing a dielectric breakdown of the air between the selected styli and the medium. Ions are created, which form the latent image on the medium.

Electrostatic images, however generated, are developed with oppositely charged toner particles. For development with liquid toners, the liquid developer is brought into direct contact with the electrostatic image. Usually a flowing liquid is employed, to ensure that sufficient toner particles are available for development. The field created by the electrostatic image causes the charged particles, suspended in a nonconductive liquid, to move by electrophoresis. The charge of the latent electrostatic image is thus neutralized by the oppositely charged particles. The theory and physics of electrophoretic development with liquid toners are well described in many books and publications.

If a reimageable photoreceptor or an electrographic master is used, the toned image is transferred to paper (or other substrate). The paper is charged electrostatically, with the polarity chosen to cause the toner particles to transfer to the paper. Finally, the toned image is fixed to the paper. For self-fixing toners, residual liquid is removed from the paper by air-drying or heating. Upon evaporation of the solvent these toners form a film bonded to the paper. For heat-fusible toners, thermoplastic polymers are used as part of the particle. Heating both removes residual liquid and fixes the toner to paper.

The image-recording layer used in the recording elements of the present invention can also contain various known additives, including matting agents such as titanium dioxide, zinc oxide, silica and polymeric beads such as crosslinked poly(methyl methacrylate) or polystyrene beads for the purposes of contributing to the non-blocking characteristics of the recording elements used in the present invention and to control the smudge resistance thereof, surfactants such as non-ionic, hydrocarbon or fluorocarbon surfactants or cationic surfactants, such as quaternary ammonium salts for the purpose of improving the aging behavior of the ink-absorbent resin or layer, promoting the absorption and drying of a subsequently applied ink thereto, enhancing the surface uniformity of the ink-receiving layer and adjusting the surface tension of the dried coating, fluorescent dyes, pH controllers, antifoaming agents, lubricants, preservatives, viscosity modifiers, dye-fixing agents, water proofing agents, dispersing agents, UV-absorbing agents, mildew-proofing agents, organic or inorganic mordants, antistatic agents, anti-oxidants, optical brighteners, and the like. Such additives can be selected from known compounds or materials in accordance with the objects to be achieved.

The following examples are provided to illustrate the invention.

EXAMPLE 1

A polyethylene resin coated paper was treated by corona discharge and coated by means of an extrusion/slide hopper with a mixture of 10% gelatin solution in water (succinylated pigskin gelatin, Kind & Knox Gelatine Co.), and 0.6% 12 micron polystyrene beads, dry thickness of about 8.5 microns. An inner layer consisting of 5% mixture of Elvanol® 52-22 poly(vinyl alcohol) (DuPont) and a 30% dispersion of Witcobond® 232 polyurethane (Witco Corp), (77:23 ratio by weight) at a dry thickness of 1.5 microns and an overcoat layer consisting of hydroxypropylmethyl cellulose (Methocel® K100LV, Dow), methyl cellulose (Methocel® A15LV, Dow) and poly(n-butyl acrylate-co-2-aminoethyl methacrylate-co-2-hydroxyethyl methacrylate) (Eastman Kodak Company) and surfactants APG 325N (Cognis) and Surfactant 10G (Arch Chemical) in a ratio by weight of 36.3/36.3/24.2/2.4/0.7 was coated at a dry thickness of 1 micron. The coatings were dried thoroughly by forced air heat after application of the coating solutions.

CONTROL EXAMPLE 1

Like example 1 except that in the overcoat layer methyl cellulose was replaced with hydroxyethyl cellulose (EEC QP300, Dow).

CONTROL EXAMPLE 2

Like example 1 except that hydroxypropylmethyl cellulose was removed.

CONTROL EXAMPLE 3

Like example 1 except that methyl cellulose was removed.

CONTROL EXAMPLE 4

Like example 1 except that poly(n-butyl acrylate-co-2-aminoethyl methacrylate-co-2-hydroxyethyl methacrylate) was removed.

CONTROL EXAMPLE 5

Like example 1 except that the overcoat layer consisted of methyl cellulose.

CONTROL EXAMPLE 6

Like example 1 except that the overcoat layer consisted of hydroxypropylmethyl cellulose.

CONTROL EXAMPLE 7

Like example 1 except that the overcoat layer consisted of hydroxyethyl cellulose.

CONTROL EXAMPLE 8

A commercial paper product of Eastman Kodak Company containing lime processed osseine gelatin.

CONTROL EXAMPLE 9

Like example 1 except that the overcoat layer consisted of poly(n-butyl acrylate-co-2-aminoethyl methacrylate-co-2-hydroxyethyl methacrylate).

Laminate Adhesion Test

A 2×4 in. composite black patch using cyan, magenta, yellow, and black ink was printed at 200% laydown at ambient room conditions with a Kodak Professional Large Format 3043 Printer using E.I Standard Process Colour Inks Catalog No. 721-6153 (light cyan), 721-6161 (light magenta), 721-4794 (yellow), 182-0612 (magenta), 721-4778 (cyan), and 840-7629 (black) (Eastman Kodak Company). Specific printer settings are listed below in Table 1:

TABLE 1

| dpi | Pattern | Quality | Microdot | Bidir |
|---|---|---|---|---|
| 720 | Stochastic | Best (photo) | Use Microdot | Yes |

About 2 hrs. after printing, ½" wide, orange, Mylar® tape was placed down the side of the print target, partly covering the 200% black patch to provide an area to initiate the peel test. The samples were then laminated with 2.6 mil of PrintGuard UV Lustre® laminate, Catalog No. 1315-3 (Hunt Corporation) using a Seal 400 Hot Roll Laminator with rolls set at 200° F., 0" nip between the rollers, at a speed of 4 ft per minute. The samples were sandwiched between 2 laminates, the test laminate on the face of the print and Seal ThermaShield® Clear Gloss, 3 mil Catalog No. 3226 (Hunt Corporation) on the back.

Using a sharp paper cutter, 1×2½ in. test strips were cut across the orange tape and the composite black patch. The laminate was peeled up from the orange tape and a 1×2½ in. leader was attached to the edge of the laminate. The leader was clamped in the upper jaw of an Instron® Model No. 1122 (Instron Corporation) and the taped portion of the sample was clamped in the lower jaw. The laminate was then peeled a distance of about ½ in. to 1 in. along the sample at a 180° angle with a crosshead constant rate of extension of 4" per minute and a calibrated load cell with a capacity of 2 kg. A plot of peel force versus time was made and by averaging the pull force over the plateau region of the peel, an average peel force was calculated in Newtons/meter. The results of the peel force test are reported in Table 2.

TABLE 2

| Example | Laminate adhesion |
|---|---|
| Example 1 | 481 |
| Control Example 1 | 227 |
| Control Example 2 | 345 |
| Control Example 3 | 359 |
| Control Example 4 | 121 |
| Control Example 5 | 166 |
| Control Example 6 | 80 |
| Control Example 7 | 46 |
| Control Example 8 | 54 |
| Control Example 9 | 254 |

The above results show that the elements of the invention have superior laminate adhesion while generally maintaining image quality compared to the control elements.

The invention has been described in detail with particular reference to certain preferred embodiments thereof, but it will be understood that variations and modifications can be effected within the spirit and scope of the invention.

What is claimed is:

1. An ink recording element comprising a support having thereon a hydrophilic absorbing layer comprising succinylated gelatin and an adhesion promoting hydrophilic overcoat polymer layer comprising cellulose ether and vinyl latex polymer, wherein said cellulose ether comprises hydroxypropylmethyl cellulose and methyl cellulose.

2. The ink recording element of claim 1 wherein said vinyl latex polymer comprises the following formula:

$$—A_x—B_y—C_z—$$

wherein:

A is a hydrophilic or reactive, vinyl monomer;

B is a hydrophobic, vinyl monomer;

C is a vinyl monomer bearing ionic charge;

x is from about 10 to about 80 mole %;

y is from about 0 to about 85 mole %; and z is from about 2 to about 20 mole %.

3. The ink recording element of claim 1 wherein said vinyl latex polymer comprises poly(n-butyl acrylate-co-2-aminoethyl methacrylate-co-2-hydroxyethyl methacrylate).

4. The ink recording element of claim 1 further comprising at least one hydrophilic inner layer between said hydrophilic absorbing layer and said hydrophilic overcoat polymer layer.

5. The ink recording element of claim 4 wherein said inner layer has a dry thickness of from 0.5 to 5 microns.

6. The ink recording element of claim 4 wherein said inner layer comprises a poly(vinyl alcohol).

7. The ink recording element of claim 6 wherein said inner layer further comprises a polyurethane dispersion.

8. The ink recording element of claim 1 wherein said succinylated gelatin comprises pigskin gelatin.

9. The ink recording element of claim 1 wherein said succinylated gelatin comprises gelatin modified with alkylenesuccinic acid.

10. The ink recording element of claim 9 wherein said alkylenesuccinic acid is dodecenylsuccinic acid.

11. The ink recording element of claim 1 wherein said hydrophilic absorbing layer has a dry thickness of from 5 to 60 microns.

12. The ink recording element of claim 1 wherein said hydrophilic absorbing polymer layer has a dry thickness of from 0.5 to 5 microns.

13. The ink recording element of claim 1 wherein said hydrophilic absorbing layer further comprises unmodified gelatin.

14. The ink recording element of claim 1 wherein said ink recording element further comprises dye mordants.

15. The ink recording element of claim 1 wherein the ratio of said cellulose ether to said vinyl latex polymer is between 95:5 and 50:50.

16. The ink recording element of claim 1 wherein said ink recording element comprises an inkjet recording element.

17. An ink printing method comprising providing an ink recording element comprising a support having a hydrophilic absorbing layer comprising succinylated gelatin and an adhesion promoting hydrophilic overcoat polymer layer comprising cellulose ether and vinyl latex polymer, and applying liquid ink droplets thereon in on image-wise manner, wherein said cellulose ether comprises hydroxypropylmethyl cellulose and methyl cellulose.

18. The method of claim 17 wherein said vinyl latex polymer comprises the following formula: wherein:

A is a hydrophilic or reactive, vinyl monomer;

B is a hydrophobic, vinyl monomer;

C is a vinyl monomer bearing ionic charge;

x is from about 20 to about 80 mole %;

y is from about 0 to about 85 mole %; and z is from about 2 to about 20 mole %.

19. The method of claim 17 wherein said vinyl latex polymer comprises poly(n-butyl acrylate-co-2-aminoethyl methacrylate-co-2-hydroxyethyl methacrylate).

20. The method of claim 17 wherein said support further comprises at least one hydrophilic inner layer between said hydrophilic absorbing layer and said hydrophilic overcoat polymer layer.

21. The method of claim 17 wherein said gelatin comprises pigskin gelatin.

22. The method of claim 17 wherein said hydrophilic absorbing layer further comprises unmodified gelatin.

23. The method of claim 17 wherein said ink recording element further comprises dye mordants.

24. The method of claim 17 wherein the ratio of said cellulose ether to said vinyl latex polymer is between 95:5 and 50:50.

25. The method of claim 17 wherein said ink recording element comprises on inkjet recording element.

26. An ink recording element comprising a support having thereon a hydrophilic absorbing layer comprising succinylated gelatin and a hydrophilic overcoat polymer layer comprising cellulose ether and vinyl latex polymer wherein said vinyl latex polymer comprises poly(n-butyl acrylate-co-2-aminoethyl methacrylate-co-2-hydroxyethyl methacrylate).

* * * * *

UNITED STATES PATENT AND TRADEMARK OFFICE

CERTIFICATE OF CORRECTION

PATENT NO. : 6,811,838 B2 
DATED : November 2, 2004
INVENTOR(S) : Charles E. Romano, Jr. et al.

It is certified that error appears in the above-identified patent and that said Letters Patent is hereby corrected as shown below:

Column 15,
Line 7, "absorbing" change to -- overcoat --
Line 24, "on" change to -- an --

Signed and Sealed this

Twenty-second Day of February, 2005

JON W. DUDAS
*Director of the United States Patent and Trademark Office*